US007028710B2

(12) United States Patent
Joergensen

(10) Patent No.: US 7,028,710 B2
(45) Date of Patent: Apr. 18, 2006

(54) HYDRAULIC VALVE SYSTEM

(75) Inventor: Martin Raadkjaer Joergensen, Soenderborg (DK)

(73) Assignee: Sauer-Danfoss ApS, (DK)

( * ) Notice: Subject to any disclaimer, the term of this patent is extended or adjusted under 35 U.S.C. 154(b) by 102 days.

(21) Appl. No.: 10/445,599

(22) Filed: May 27, 2003

(65) Prior Publication Data

US 2003/0226597 A1 Dec. 11, 2003

(30) Foreign Application Priority Data

Jun. 5, 2002 (DE) ..... 102 24 827

(51) Int. Cl.
*F15B 13/042* (2006.01)

(52) U.S. Cl. ..... 137/596.2; 91/420

(58) Field of Classification Search ..... 91/420; 137/596.2

See application file for complete search history.

(56) References Cited

U.S. PATENT DOCUMENTS 1,955,154 A * 4/1934 Temple ..... 91/420
2,483,312 A * 9/1949 Clay ..... 91/420
2,959,190 A * 11/1960 Barnes et al. ..... 91/420
3,125,120 A 3/1964 Hasbany
3,272,085 A * 9/1966 Hajma ..... 91/420
3,818,936 A * 6/1974 Jackoboice et al. ..... 91/420
3,974,742 A * 8/1976 Johnson ..... 91/420
4,286,432 A 9/1981 Burrows et al.
4,344,355 A 8/1982 Schwerin
4,518,004 A * 5/1985 Hsu et al. ..... 137/115.18
4,651,624 A 3/1987 Beck
4,688,381 A 8/1987 Aichele et al.
6,220,289 B1 4/2001 Zenker et al.
6,253,859 B1 7/2001 Coenen
6,427,721 B1 8/2002 Zenker et al.
6,581,639 B1 6/2003 Fiala et al.
2003/0201016 A1* 10/2003 Fiala et al. ..... 137/596.2

FOREIGN PATENT DOCUMENTS

DE 4028887 A1 3/1992

* cited by examiner

*Primary Examiner*—Stephen M. Hepperle

(57) ABSTRACT

A hydraulic valve system (1) has a supply connection arrangement, having a high-pressure connection (P) and a low-pressure connection, with a working connection arrangement, having two working connections (A, B), with a control valve (3), which is arranged between the supply connection arrangement and the working connection arrangement, and with a non-return valve (24, 28) for each working connection (A, B). The valve being arranged between the control valve (3) and the working connection arrangement. A tappet (36) mechanically opening the valve element (25, 29) of said non-return valve.

19 Claims, 1 Drawing Sheet

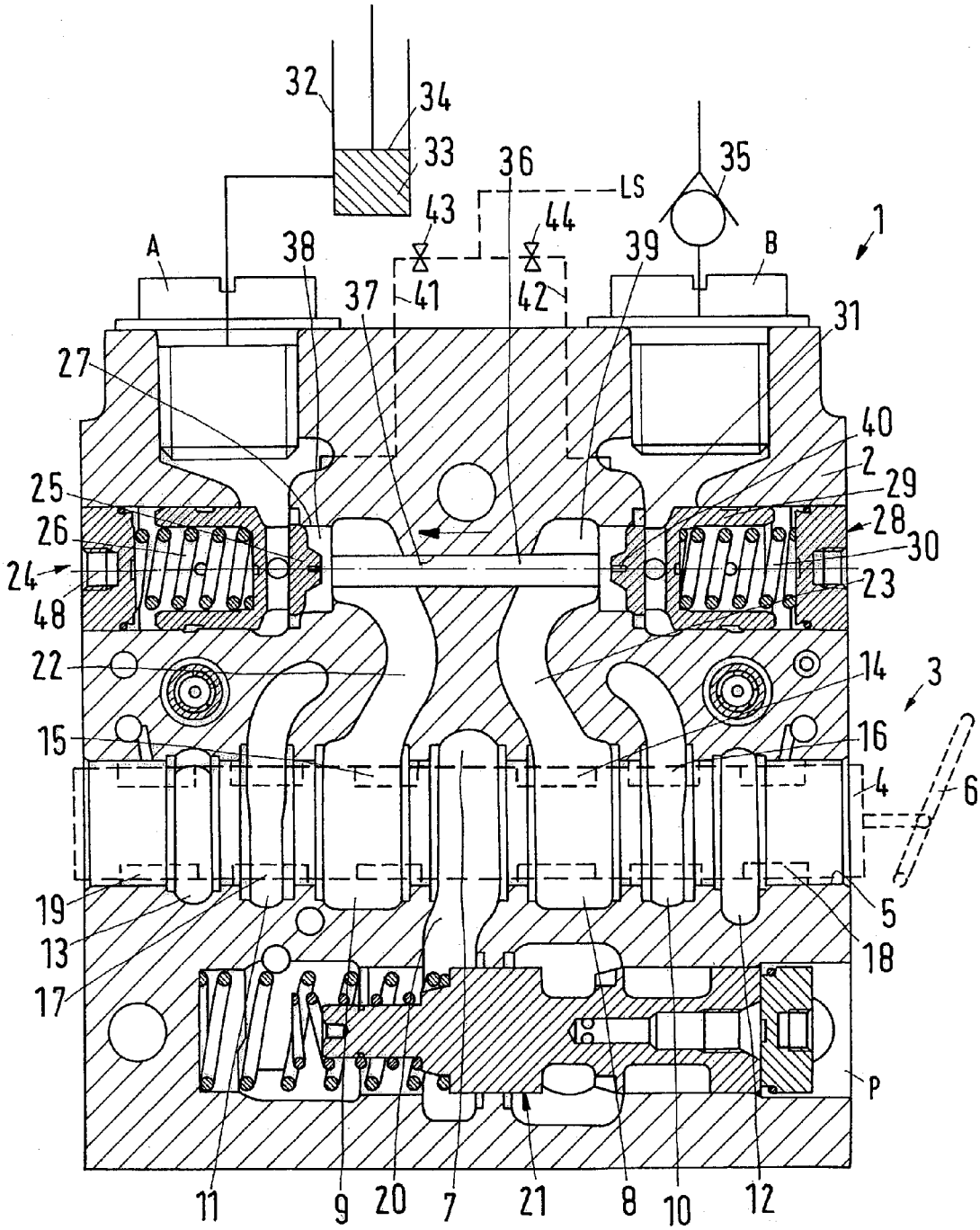
32
34
33
36
LS
35
43
44
1
A
38
39
B
37
41
42
31
27
40
2
25
29
26
28
30
24
23
48
22
14
3
15
16
4
6
19
5
13
18
17
P
11
9
20
7
21
8
10
12

HYDRAULIC VALVE SYSTEM

BACKGROUND OF THE INVENTION

The invention concerns a hydraulic valve system with a supply connection arrangement, having a high-pressure connection and a low-pressure connection, with a working connection arrangement, having two working connections, with a control valve, which is arranged between the supply connection arrangement and the working connection arrangement, and with a non-return valve for each working connection, said valve being arranged between the control valve and the working connection in question, a tappet mechanically opening the valve element of said non-return valve.

A hydraulic valve system of this kind is known from DE 40 28 887 A1. Here, the tappet for opening the non-return valve in question is activated via a slant on the slide of the control valve. Through the opening of the non-return valve, a returning of the motor to a non-deflected or non-extended state will also be possible, when only a small load, for example the dead weight, acts upon the motor, this load being so small that it cannot provide the pressure required across some auxiliary valves to open the non-return valve.

A hydraulic valve system with non-return valves is particularly intended for mounting on tractors or other kinds of mobile equipment. The non-return valves are meant to ensure a substantially drop-free behaviour, that is, they should retain the motor connected to the working connection arrangement in a certain position, when this has been set so by the control valve. The non-return valves are opened by means of a pilot pressure. This appears from, for example, DE 199 31 142 A1 or 199 19 015 A1. However, it is necessary that the motor can produce a sufficient pilot pressure.

With double-acting motors (or other consumers) this is usually no problem, as, when being moved in one direction by the pressure at one working connection, the motor automatically produces a correspondingly large pressure at the other working connection, which is then used to open the non-return valves. With single-acting motors, this is not the case. As fluid is only available on one side of the motor, it can only be activated in one direction. In order to be able to revert to a starting position, it has to be acted upon by a load in the opposite direction.

Basically, it is not known for sure in advance, which consumer is to be connected to the valve arrangement. Therefore, both with double acting motors and with single-acting motors, the valve arrangement must be able to open the non-return valves. When, for example, a tractor linkage drawbar is controlled by the valve arrangement, however, no weight resting on the drawbar, then there is hardly no load for lowering the drawbar. The pressure in the tank line would have to be close to 0 bar, which is usually very hard to realise.

Therefore, in DE 40 28 887 A1 a forced opening of the non-return valves is provided. When the slide of the control valve is moved in one direction, it produces the hydraulic connections required to operate the motor in one direction. At the same time, the non-return valve is opened via the tappet and the slide, to enable a discharge of the fluid from the opposite pressure chamber of the motor.

However, this embodiment has some disadvantages. Firstly, a relatively large friction occurs between the slide of the control valve and the tappet of the non-return valve, which is, for example, a disadvantage, when the slide is to be electrically activated. Further, with this embodiment a partly substantial wear can be seen, which involves the risk that eventually the valve arrangement will become unable to work.

SUMMARY OF THE INVENTION

The invention is based on the task of providing a reliable opening of the non-return valve serving the supply, when using a merely single-acting motor.

With a hydraulic valve system as mentioned in the introduction, this task is solved in that on the side facing away from the valve element the tappet ends in a pressure chamber, which can be acted upon with pressure.

Through the pressure acting upon the pressure chamber, the tappet is moved, thus opening the valve element of the non-return valve. Thus, this opening will no longer require a deflection of mechanically acting forces. The tappet is acted upon hydraulically. However, hydraulic forces can act upon the tappet substantially without causing wear. Accordingly, the wear is kept small and this ensures a durable, reliable opening of the non-return valve. It is relatively simple to produce a pressure on the tappet. An increased pressure is available in the system anyway. It is merely required to direct this pressure to the corresponding front side of the tappet with suitable measures.

It is preferred that the pressure chamber of the tappet for a non-return valve is limited by the valve element of the other non-return valve. With this embodiment it is achieved that the slide of the control valve (or a corresponding valve element) merely has to be activated so that the pressure is led to the second non-return valve, when the first non-return valve has to be opened. With this embodiment it becomes optional to drive the valve arrangement either with a motor, which is arranged at both working connections or with a motor, which is arranged at only one working connection, thus being single acting. With this embodiment, the free working connection merely has to be closed. When by means of the control valve the pressure is led to the closed working connection, the non-return valve here will be opened. However, the tappet will be moved accordingly, so that also the non-return valve at the other working connection is opened. The opening of the non-return valve at the closed working connection is uncritical, as the hydraulic fluid cannot escape anyway, regardless if the non-return valve is open or not.

It is particularly preferred that a common tappet is provided for both non-return valves. The tappet can open the first or the second non-return valve, when the pressure acts upon the second or the first non-return valve, respectively. The use of one single tappet simplifies the design. Additionally, it involves the advantage that the single-acting motor can be connected to any of the two working connections, without influencing the function of the valve arrangement negatively.

The tappet is shorter than the distance between the valve elements of the two non-return valves. In a mode of operation, in which both working connections are connected with the motor, the tappet does not impair. It may be acted upon in such a way that it opens a non-return valve, when the other non-return valve is opened by the pressure at the high-pressure connection, which is led there by the control valve. In this case, however, the opening of the other non-return valve is required anyway. When the tappet is shorter than the distance between the valve elements of the two non-return valves, there will at least be one position, in which the tappet acts upon none of the two non-return valves.

The valve element and/or the tappet have on their common contact face at least one recess, which permits the penetration of fluid between the tappet and the valve element. Thus, it is ensured that the pressure can also act upon the corresponding front side of the tappet, to displace the tappet. Otherwise, the tappet can be relatively thin. The force acting upon the tappet merely has to be sufficient to overcome a force, which is, for example, produced by a closing spring on the valve element of the non-return valve. Such a recess can, for example, be a groove, which is arranged in the surface of the valve element of the non-return valve. It can also be a projection on the front side of the tappet. Other embodiments can be imagined and found by the person skilled in the art without trouble.

Preferably, the tappet and the valve elements of the two non-return valves have a common movement axis. Thus, the tappet and the two valve elements move along a straight line. This keeps the wear small. The tappet is only loaded along its movement direction. The guiding of the tappet in the housing is not loaded by laterally acting forces.

The pressure chamber can be connected with a leakage oil discharge arrangement. During normal operation, the tappet will have no influence on the valve function. However, to be completely certain that no pressure can build up unintentionally at the working connections, which could then influence the tappet, the leakage oil discharge arrangement has been provided, through which a correspondingly excess amount of hydraulic fluid can be discharged, before the pressure gets too high. When the control valve is in the neutral position, the leakage oil discharge arrangement ensures that a leakage cannot cause a pressure build-up at the working connections.

It is preferred that the leakage oil discharge arrangement has a bleed, which creates a connection to the low-pressure connection. The bleed prevents that, in connection with an intended pressure increase in the corresponding pressure chamber, too much hydraulic fluid can flow off.

The bleed is arranged in a load-sensing line, which is connected with the low-pressure connection in the neutral position of the control valve. This is a relatively simple embodiment. The load sensing line is connected with the working connections anyway. This is required to be able to report the highest pressure occurring in the system to the pump or a control device connected with the pump. This load-sensing line can now be assigned a second function. It namely serves the purpose of discharging small leakage amounts of hydraulic fluid.

Preferably, the valve element can be opened both mechanically by means of the tappet and hydraulically. The hydraulic opening of the valve is typically used with high pressures, for example 10 bar to 400 bar, and large flow amounts, whereas the mechanical solution is used with small pressures, for example between 0 and 10 bar, and small flow amounts.

BRIEF DESCRIPTION OF THE DRAWING

FIG. 1 is a schematic cross-sectional view of the invention.

DESCRIPTION OF THE PREFERRED EMBODIMENT

A hydraulic valve system 1 has a housing 2. In the housing 2 are provided two working connections A, B, forming together a working connection arrangement. Further, there is a high-pressure connection P and a low-pressure connection (not shown in detail), together forming a supply pressure connection. Between the working connection arrangement A, B and the supply pressure connection P is arranged a control valve 3, which has a merely schematically shown slide 4, which is displaceable in a bore 5 in the housing 2 under the influence of a drive 6. The bore 5 has a number of circumferential grooves 7 to 13. The slide 4 has a number of circumferential grooves 14 to 19. By means of a displacement of the slide 4, the circumferential grooves 14 to 19 can be positioned so that certain neighbouring circumferential grooves 7 to 13 in the bore 5 are connected with each other. The view of the slide 4 with its grooves 14 to 19 is not true to scale. As, however, the design of such a control valve 3 with a slide 4 in a bore is known per se, and a detailed description will not be provided.

Via a channel 20 the circumferential groove 7 is connected with the outlet of a compensation valve 21. The inlet of the compensation valve 21 is connected with the high-pressure connection P. The compensation valve 21, which can also be called pressure balance valve, ensures that the same pressure drop always rules over the control valve 3.

Via a first working line 22, the control valve 3 is connected with the working connection A and via a second working line 23 with the working connection B. In the first working line 22 is arranged a non-return valve 24, which has a valve element 25, which is brought to rest on a valve seat 27 by means of a pressure spring 26. A pressure, which rules in the working line 22, can open the non-return valve 24. A condition for this is that the pressure in the working line 22 is large enough to overcome the force of the pressure spring 26. Of course, there are several different possibilities of opening the valves 24 and 28. It is also possible to connect part of the area of the non-return valve on the load side with low pressure (on the spring side) and at the same time overcome the remaining spring force by means of the load pressure via a differential area.

In a similar manner, a non-return valve 28 is arranged in the working line 23, said valve 28 having a valve element 29, which is pressed against a valve seat 31 by means of a pressure spring 30. The valve element 29 can be lifted from the valve seat 31, when the pressure in the second working line 23 is large enough. The pressure in the two working lines 22, 23 is controlled by the slide 4 of the control valve 3.

FIG. 1 shows an operating situation, in which a single-acting motor 32 is merely connected with the working connection A. The motor 32 has a pressure chamber 33, which is limited by a movable piston 34. When the working line 22 is put under pressure by a corresponding position of the slide 4 of the control valve 3, the non-return valve 24 is opened and the hydraulic fluid from the working line 22 can flow into the pressure chamber 33 of the motor 32 via the working connection A. The other working connection B is closed. This is symbolised by a non-return valve 35.

A return movement of the piston 34 under reduction of the pressure chamber 33 is not possible without further measures. When the pressure in the working line 22 drops, the non-return valve 24 closes, and the working connection A is closed.

For this reason, a tappet 36 is arranged between the two valve elements 25, 29, said tappet 36 being displaceable in a bore 37 in the housing. The axis of the bore and thus the axis of the tappet 36 correspond with the axis 48 of the valve elements 25, 29 of the non-return valves 24, 28.

In front of the non-return valve 24, the working line 22 has a first pressure chamber 38. The pressure in the first pressure chamber 38 controls the opening movement of the valve element 25 of the first non-return valve 24. In a similar manner, the second working line 23 has a pressure chamber 39 in front of the non-return valve 28. The pressure in the pressure chamber 39 controls the opening movement of the valve element 29 of the second non-return valve 28.

The tappet 36 now ends in the two pressure chambers 38, 39. The pressure in the two pressure chambers 38, 39, acts upon the tappet 36. When the pressure in the second pressure chamber 39 is larger than the pressure in the first pressure chamber 38, the tappet 36 will be displaced in the direction of the valve element 25 of the first non-return valve 24. When the pressure in the second pressure chamber 39 is sufficient to produce a force, which is larger than the force produced by the pressure spring 26 on the valve element 25 of the first non-return valve 24, the tappet 36 is able to lift the valve element 25 from the valve seat 27 and accordingly to release a connection from the working connection A to the first working line 22. This can be used to lower the piston 34 of the motor 32.

The slide 4 of the control valve 3 is displaced so that the channel 20 of the compensation valve 21 is connected with the second working line 23. Accordingly, a pressure builds up in the second pressure chamber 39, which displaces the tappet 36 in the direction of the valve element 25 of the first non-return valve 24, that is, to the left in the drawing, and lifts the valve element 25 from the valve seat 27 against the force of the pressure spring 26. At the same time, the slide 4 has established a connection between the first working line 22 and the low-pressure connection (not shown in detail), which can, for example, be connected with the two grooves 10, 11, so that the hydraulic fluid can flow off from the pressure chamber 33 of the motor 32.

In the shown resting position, the tappet 36 bears on the valve element 29 of the second non-return valve 28. In order to ensure that hydraulic fluid can get between the valve element 29 and the tappet 36, the valve element 29 has a recess 40, in the present case a groove, in its surface. This recess 40 does not have to be large. It only has to be large enough to produce a pressure on the tappet 36, which is sufficient to lift the tappet 36 from the valve element 29. Then, the whole front face of the tappet is available for pressurising.

The length of the tappet 36 is shorter than the distance between the two valve elements 25, 29. Thus, in the resting position, it is indeed possible and also anticipated that the two non-return valves 24, 28 are closed.

When the connection arrangement is changed, for example in that a double-acting motor is connected to the two working connections A, B, the tappet 36 is able to open the non-return valve 24, 28, whose pressure chamber 38, 39 does not have sufficient pressure to open it. When, for example, the working connection A shall be exposed to pressure, a corresponding pressure is available in the first working line 22 under the control of the slide 4 of the control valve 3. This pressure is able to open the non-return valve 24. At the same time, the tappet 36 is displaced to the right and opens the second non-return valve 28, so that fluid can flow off from the working connection B via the working line 23. Thus, the valve arrangement 1 can be used without modifications both when a single-acting motor is connected and when a double-acting motor is connected.

During normal operation, the tappet 36 will have no influence on the valve function. However, to make completely sure that a pressure cannot unintentionally build up in the working lines 22, 23 or the working connections A, B, which could open the non-return valves 24, 28, the working connections A, B are connected with a load-sensing connection LS via lines 41, 42. However, in this connection a bleed 43, 44 is provided for each working connection A, B. Via these bleeds 43, 44, a leakage fluid, which, in the neutral position of the slide 4 in the housing 2, reaches one or both working lines 22, 23, can flow off. In the neutral position of the slide 4, the LS-line is connected with the low-pressure connection.

Of course, also other possibilities of the leakage fluid discharge exist, as long as it is ensured that too much fluid cannot flow off unused, in the deflected position of the slide 4, in which a corresponding amount of hydraulic fluid under pressure is supposed to flow to one of the two working connections A, B.

It is therefore seen that the invention will achieve at least all of its stated objectives.

What is claimed is:

1. A hydraulic valve system with a supply connection arrangement, having a high-pressure connection and a low-pressure connection, with a working connection arrangement, having two working connections, with a control valve, which is arranged between the supply connection arrangement and the working connection arrangement, and with a non-return valve for each working connection, said valve being arranged between the control valve and the working connection in question, a tappet having a uniform diameter and mechanically opening a valve element of said non-return valve, wherein the uniform diameter of the tappet is less than a diameter of the valve element and wherein, the tappet (36) has a side facing away from the valve element (25, 29), on which side the tappet ends in a pressure chamber (38, 39), which can be acted upon with pressure.

2. A valve system according to claim 1, wherein the pressure chamber (38, 39) of the tappet (36) for one non-return valve (24, 28) is limited by the valve element (29, 25) of the other non-return valve (28, 24).

3. The valve system according to claim 1, wherein a common tappet (36) is provided for both non-return valves (24, 28).

4. The valve system according to claim 3, wherein the tappet (36) is shorter than the distance between the valve elements (25, 29) of the two non-return valves (24, 28).

5. The valve system according to claim 3, wherein the valve element(25, 29) and the tappet (36) have common contact faces with at least one recess (40), which permits the penetration of fluid between the tappet (36) and the valve element (25, 29).

6. The valve system according to claim 1, wherein the tappet (36) and the valve elements (25, 29) of the two non-return valves have a common movement axis (48).

7. The valve system according to claim 1, wherein the pressure chamber (38, 39) can be connected with a leakage oil discharge arrangement (41 to 44).

8. The valve system according to claim 7, wherein the leakage oil discharge arrangement (41 to 44) has a bleed (43, 44), which creates a connection to the low-pressure connection.

9. The valve system according to claim 7, wherein the bleed (43, 44) is arranged in a load-sensing line (LS), which is connected with the low-pressure connection in a neutral position of the control valve (3).

10. The valve system according to claim 1, wherein the valve element (25, 29) can be opened both mechanically by means of the tappet (36) and hydraulically.

11. A hydraulic valve system with a supply connection arrangement, having a high-pressure connection and a low-pressure connection, with a working connection arrangement, having two working connections, with a control valve, which is arranged between the supply connection arrangement and the working connection arrangement, and with a non-return valve for each working connection, said valve being arranged between the control valve and the working connection in question, a tappet mechanically opening a valve element of said non-return valve, wherein, the tappet (36) has a side facing away from the valve element (25, 29), on which side the tappet ends in a pressure chamber (38, 39), which can be acted upon with pressure, wherein the valve element (25, 29) can be opened both mechanically by means of the tappet (36) and hydraulically, wherein the valve element is opened mechanically when pressure within the pressure chamber acts upon the side of the tappet facing away from the valve element to displace the tappet toward the valve element such that the valve element is lifted from a valve seat, and wherein one of the two working connections is closed.

12. A valve system according to claim 11, wherein the pressure chamber (38, 39) of the tappet (36) for one non-return valve (24, 28) is limited by the valve element (29, 25) of the other non-return valve (28, 24).

13. The valve system according to claim 11, wherein a common tappet (36) is provided for both non-return valves (24, 28).

14. The valve system according to claim 13, wherein the tappet (36) is shorter than the distance between the valve elements (25, 29) of the two non-return valves (24, 28).

15. The valve system according to claim 13, wherein the valve element (25, 29) and the tappet (36) have common contact faces with at least one recess (40), which permits the penetration of fluid between the tappet (36) and the valve element (25, 29).

16. The valve system according to claim 11, wherein the tappet (36) and the valve elements (25, 29) of the two non-return valves have a common movement axis (48).

17. The valve system according to claim 11, wherein the pressure chamber (38, 39) can be connected with a leakage oil discharge arrangement (41 to 44).

18. The valve system according to claim 17, wherein the leakage oil discharge arrangement (41 to 44) has a bleed (43, 44), which creates a connection to the low-pressure connection.

19. The valve system according to claim 17, wherein the bleed (43, 44) is arranged in a load-sensing line (LS), which is connected with the low-pressure connection in a neutral position of the control valve (3).

* * * * *